United States Patent [19]

Valerio, Jr.

[11] 4,066,144

[45] Jan. 3, 1978

[54] RESCUE APPARATUS

[76] Inventor: Joseph F. Valerio, Jr., 118 W. Sixth St., Bridgeport, Pa. 19405

[21] Appl. No.: 756,636

[22] Filed: Jan. 4, 1977

[51] Int. Cl.[2] ..... A62B 1/22

[52] U.S. Cl. ..... 182/140

[58] Field of Search ..... 182/137, 138, 139, 140; 272/65

[56] References Cited

U.S. PATENT DOCUMENTS

| | | | |
|---|---|---|---|
| 663,856 | 12/1900 | Browder | 182/140 |
| 3,805,916 | 4/1974 | Milam | 182/138 |

*Primary Examiner*—Reinaldo P. Machado

*Attorney, Agent, or Firm*—Zachary T. Wobensmith, 2nd; Zachary T. Wobensmith, III

[57] ABSTRACT

Rescue apparatus is described for use in the rescue of persons from high rise and other buildings, which includes a net of flexible material carried by a frame that extends outwardly from a window below the location of the person to be rescued, with portions engaged with the floor and ceiling of the room which apparatus is extensible, collapsible, foldable, and portable to provide easy assembly for use.

The apparatus includes cushioning members on the frame carrying the net and a scoop inside the net to direct the rescued person inside the window.

8 Claims, 5 Drawing Figures

RESCUE APPARATUS

BACKGROUND OF THE INVENTION

1. Field of the Invention

This invention relates to rescue apparatus of the collapsible type intended to extend from a window of a building with support members bearing on the floor and ceiling of a room, and with an extensible portion outside the window supporting a flexible net.

2. Description of the Prior Art

With the ever increasing number of high rise buildings for office and residential use, there has come a realization that a simple portable rescue apparatus is desirable in the event of fire or other catastrophe. Various structures have been proposed such as the one shown in the U.S. Pat. to James No. 2,450,595 which illustrates a net permanently mounted to and carried by girders on each end of a building, which net is movable on rods across the outer face of the building when use is desired.

The U.S. Pat. to Milam No. 3,805,916 illustrates an escape apparatus which includes a foldable net, which extends out a window to catch a person falling from above. The Milam structure requires a person to sit on it inside the window for counterbalance, would impart a violent upward impact to the person inside, must rest on the window sill and lacks many features of my invention.

The German Pat. to Meyer No. 950,755 shows a net suspended on the exterior wall of a building by extensible frame members that also protrude beyond the wall and would interfere with safe use of the net.

The apparatus of my invention does not require any counterbalancing, is not permanently attached to a building and has many other unique and desirable features.

SUMMARY OF THE INVENTION

This invention relates to a foldable, collapsible, portable rescue apparatus which has adjustable legs engaged with the floor and ceiling of a room and an extensible portion extending out a window supporting a net and a scoop for catching persons falling or jumping from above and directing them inside the building.

The principal object of the invention is to provide rescue apparatus that is simple to make but provides a safe apparatus for rescuing falling persons.

A further object of the invention is to provide rescue apparatus that can be used in a variety of types of buildings.

A further object of the invention to to provide rescue apparatus that can be quickly installed by a single person.

A further object of the invention is to provide rescue apparatus that can be quickly and easily transported to the site of use.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

Figure 1:
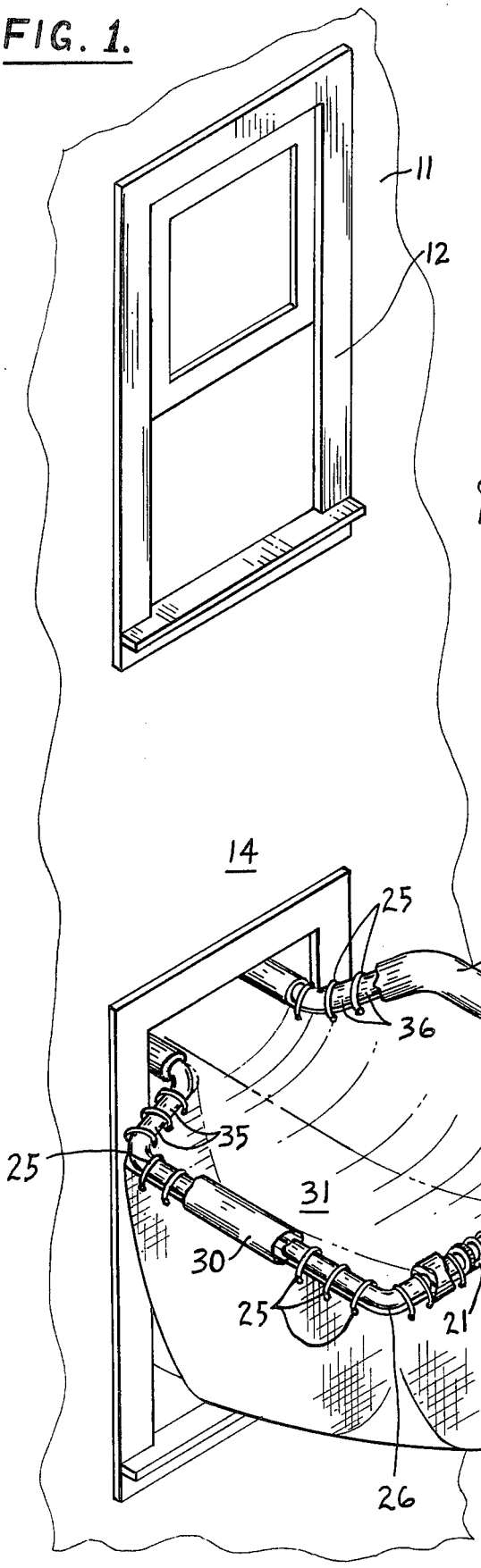
FIG. 1 is a view in perspective showing the rescue apparatus in position for use.
Figure 2:
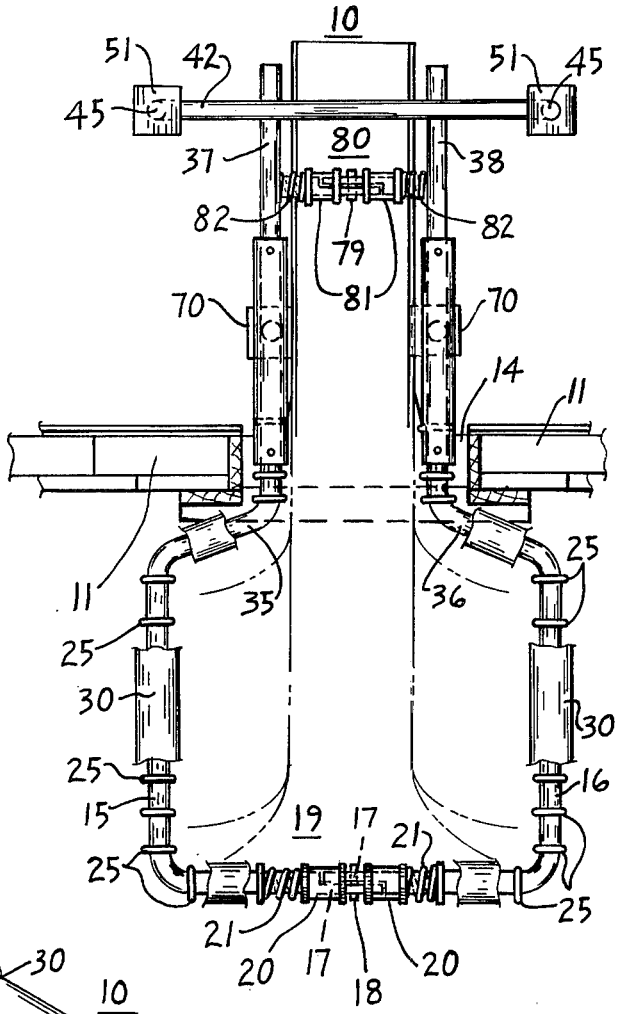
FIG. 2 is a top plan view of the apparatus of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the rescue apparatus 10 is shown in place in a building having a front wall 11, a window 12, and a window 14 directly below the window 12.

The apparatus 10 includes a frame having a pair of tubular arms 15 and 16 of generally rectangular shape with complemental offsets 17 secured together by a pin 18 providing a hinge 19 for pivotal movement of the arms 15 and 16. Each arm 15 or 16 is provided with a spool 20 adjacent the offset 17 which spool 20 is urged towards the pin 18 by spring 21 on the arm to lock the arms 15 and 16 in a fixed position for use.

Between the arms 15 and 16 a net 22 is provided of a sturdy flexible material such as nylon fabric which is secured to the arms 15 and 16 by a plurality of rings 25 preferably formed of bungy cord engaging the net 22 below a frame 26 which is integral with the net and extends around the arms 15 and 16.

A layer of spongy material 30, of a suitable resilient foam material is provided encasing the arms 15 and 16 and the rings 25.

On top of the net 22 as seen in FIG. 1 a scoop 31 is preferably provided also secured to arms 15 and 16 by the rings 25, of a lesser width than net 22, and elevated at the hinge 19 to direct a falling person or object into the opening at window 14.

Each of the arms 15 and 16 has an additional offset portion 35 or 36 which have straight arm portions 37 and 38 extending therefrom into the building through the opening at the window 14 and rearwardly of wall 11.

The arm 37 is detachably secured by a pin 40 to a U-shaped bracket 41 which is secured to a tubular member 42 carried by posts 45. The arm 38 is pivotedly secured to the member 42 by a bracket 48 within which it may rotate.

The posts 45 each has an upper member 50 with a flat rectangular plate 51 thereon for engagement with the ceiling 52 of the building and a lower tubular member 55 slidable within member 50 and detachably secured thereto by pin 56 which can be inserted in any pair of a plurality of holes 57 in member 55 and in holes 58 in member 50 varying the extensible length of posts 45. The members 55 can be provided at their lower ends with screw jacks which include a rod 61 in threaded engagement with the member 55, and with a plate 62 engageable with the floor 63 of the building.

In a preferred embodiment, the posts 45 have an extensible length of from 7 to 10 feet.

Figure 4:
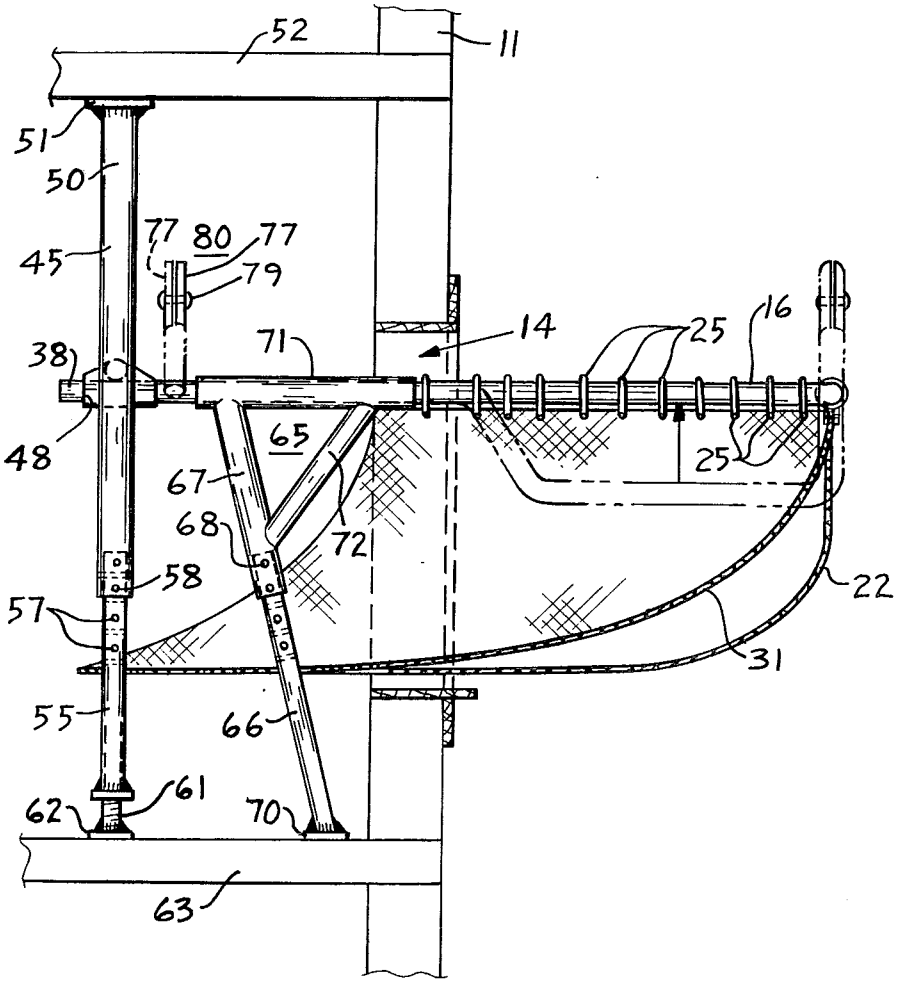
FIG. 4 is a vertical sectional view taken approximately on the line 4—4 of FIG. 3.
Figure 3:
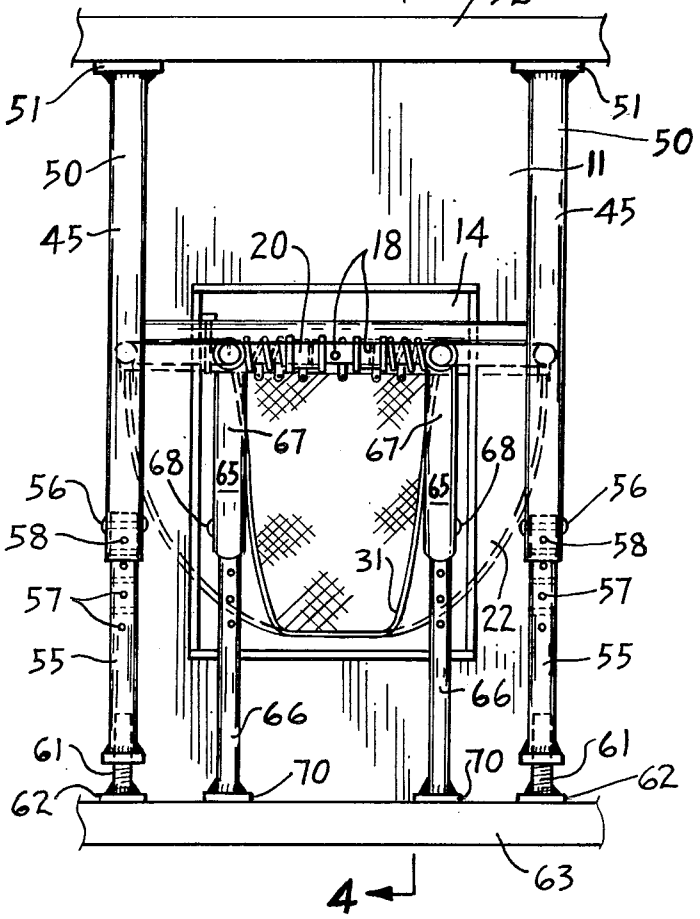
FIG. 3 is a rear elevational view of the apparatus of FIG. 1.

The arms 37 and 38 are each provided with posts 65 extending downwardly as shown in FIGS. 3 and 4 of two piece tubular construction with a lower member 66 being adjustably connected to an upper member 67 by a pin 68 through a plurality of holes 69. The lower members 66 have plates 70 thereon which are engaged with the floor 63 forwardly of the posts 45.

The posts 65 include a socket portion 71 to which upper member 67 is attached and include an additional member 72 between member 67 and socket 71.

The arms 37 and 38 have transverse portions 75 and 76 extending towards each other from the arms with offsets 77 and 78 pivotally secured together by pin 79 to form hinge 80.

Spools 81 are provided on members 72 and 73 urged toward pin 79 by springs 82.

The mode of operation will now be pointed out.

Figure 5:
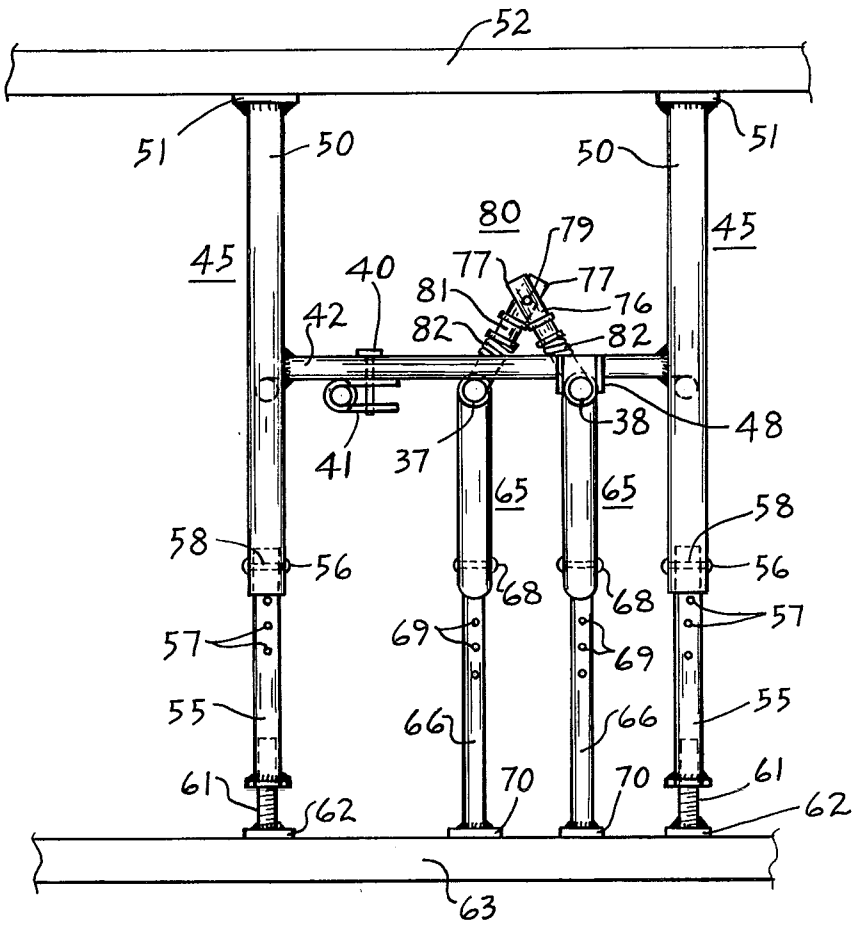
FIG. 5 is a fragmentary rear elevational view of the apparatus of FIG. 1 with the net and scoop omited.

The rescue apparatus is moved in the interior of the building behind the window 14 below the person to be rescued. The arms 37 and 38 are extended out the window 14 in folded position as shown in FIG. 5 with plates 62 and 70 resting on the floor 63. The arm 37 is moved toward the bracket 41 and pin 40 inserted therein retaining the arm 37 in fixed position. The members 55 of posts 45 and members 66 are extended until plates 51 engage the ceiling and pins 56 and 68 are inserted in the appropriate holes to retain them in position. The rod 61 is rotated to obtain a final contact of plate 62 with the floor. The spools 20 and 81, under the force of springs 21 and 82 move outwardly to lock the arms 15 and 16 in open position with the net 22 and scoop 31 ready for a falling person.

When it is desired to move the apparatus 10 for use at another location, pins 40 are removed from bracket 41 and spools 20 and 81 are moved against springs 21 and 82 to permit the arms 15 and 16 to fold downwardly about hinge pin 19, the pins 56 and 68 are removed permitting posts 45 and 65 to be collapsed and the apparatus withdrawn through window 14 where it can be taken to another location and assembled as described.

It will thus be seen that apparatus in accordance with the objects of the invention has been provided.

I claim:

1. Rescue apparatus for use in a window of a building for rescuing falling persons which comprises a pair of arms pivotally secured together, a net carried by said arms, a first pair of extensible posts detachably engaged with said arms and having members engageable with the floor and ceiling of a room, and a second pair of extensible posts secured to said arms between said net and said first pair of posts engageable with the floor of the room.

2. Rescue apparatus as defined in claim 1 in which said first mentioned posts are connected together by a cross member and at least one of said arms has a portion detachably engaged with said cross member.

3. Rescue apparatus as defined in claim 2 in which said first mentioned posts includes leg members which are extensible and have portions for engaging the floor and ceiling of the room in which the apparatus is to be used.

4. Rescue apparatus as defined in claim 1 in which said pair of arms in horizontal position have outer portions for disposition outside the building spaced apart to a greater distance than the width of the window opening.

5. Rescue apparatus as defined in claim 1 in which said arms have inner portions in spaced relation hingedly connected together, and outer portions in spaced relation and at a greater distance than said inner portions hingedly connected together.

6. Rescue apparatus as defined in claim 1 in which a scoop is provided suspended from and attached to said arms above said net to direct rescued persons interiorly of the building.

7. Rescue apparatus as defined in claim 1 in which said arms have means for locking them in position for use.

8. Rescue apparatus as defined in claim 7 in which said locking means is at least one spool carried on a portion of one of said arms and resiliently urged to locking position.

* * * * *